US012509947B1

(12) United States Patent
Gunasekaran et al.

(10) Patent No.: US 12,509,947 B1
(45) Date of Patent: Dec. 30, 2025

(54) DOWNHOLE WET MATE CONNECTION SYSTEM FOR WELLBORE TOOLS

(71) Applicant: Halliburton Energy Services, Inc., Houston, TX (US)

(72) Inventors: Mohan Gunasekaran, Singapore (SG); Michael Linley Fripp, Singapore (SG); David Allen Dockweiler, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/809,643

(22) Filed: Aug. 20, 2024

(51) Int. Cl.
*E21B 17/02* (2006.01)
*E21B 34/06* (2006.01)

(52) U.S. Cl.
CPC ..... *E21B 17/028* (2013.01); *E21B 34/066* (2013.01)

(58) Field of Classification Search
CPC ..... E21B 17/028; E21B 34/066
See application file for complete search history.

(56) References Cited

U.S. PATENT DOCUMENTS 11,248,441 B2 2/2022 Vick, Jr. et al.
2010/0025045 A1* 2/2010 Lake ..... E21B 34/066 166/373
2011/0192596 A1 8/2011 Patel
2012/0138310 A1 6/2012 Lake
2013/0032355 A1* 2/2013 Scott ..... E21B 34/066 166/373
2015/0275620 A1* 10/2015 Scott ..... E21B 23/02 166/53
2015/0368983 A1* 12/2015 Perez ..... E21B 17/028 166/378
2021/0140247 A1* 5/2021 Bishop ..... E21B 17/028
2023/0131231 A1 4/2023 Minassa et al.
2023/0151714 A1 5/2023 Garsault et al.

OTHER PUBLICATIONS

Unpublished U.S. Appl. No. 63/614,266, filed Dec. 22, 2023 - stored in USPTO Image File Wrapper System. In accordance with the Waiver of the Copy Requirements in 37 CFR 1.98 for Cited Pending U.S. Patent Applications, 1287 O.G. 163 (Oct. 19, 2004), unpublished US Patent Application is available in the IFW and, therefore, not provided.
International Patent Application No. PCT/US2024/045407, International Search Report and Written Opinion mailed May 12, 2025, 11 pages.

* cited by examiner

*Primary Examiner* — Brad Harcourt
(74) *Attorney, Agent, or Firm* — Kilpatrick Townsend & Stockton LLP

(57) ABSTRACT

A wet mate connection system can be provided for suppling power to a wellbore tool. For example, the wet mate connection system can be positioned downhole in the wellbore. The wet mate connection system can further be electrically coupled with a valve. The wet mate connection system can include a first wet mate connector and a second wet mate connector. The second wet mate connector can be coupled with the first wet mate connector and with the valve. Additionally, the wet mate connection system can include one or more electrical contacts between the first wet mate connector and the second wet mate connector.

18 Claims, 5 Drawing Sheets

DOWNHOLE WET MATE CONNECTION SYSTEM FOR WELLBORE TOOLS

TECHNICAL FIELD

The present disclosure relates generally to wellbore operations and, more particularly (although not necessarily exclusively), to a wet mate connection system that can be used to supply power to one or more wellbore tools.

BACKGROUND

Wellbore operations may include various equipment, components, methods, or techniques to perform various tasks with respect to a wellbore. For example, a subsurface safety valve can be positioned downhole to prevent uncontrolled releases of subsurface production fluids from a well. In doing so, the subsurface safety valve can prevent environmental hazards and equipment failures that may result from the uncontrolled release of production fluids. In some cases, it can be difficult (e.g., complex and costly) to supply power to wellbore tools or downhole equipment, such as subsurface safety valves.

DETAILED DESCRIPTION

Figure 1:
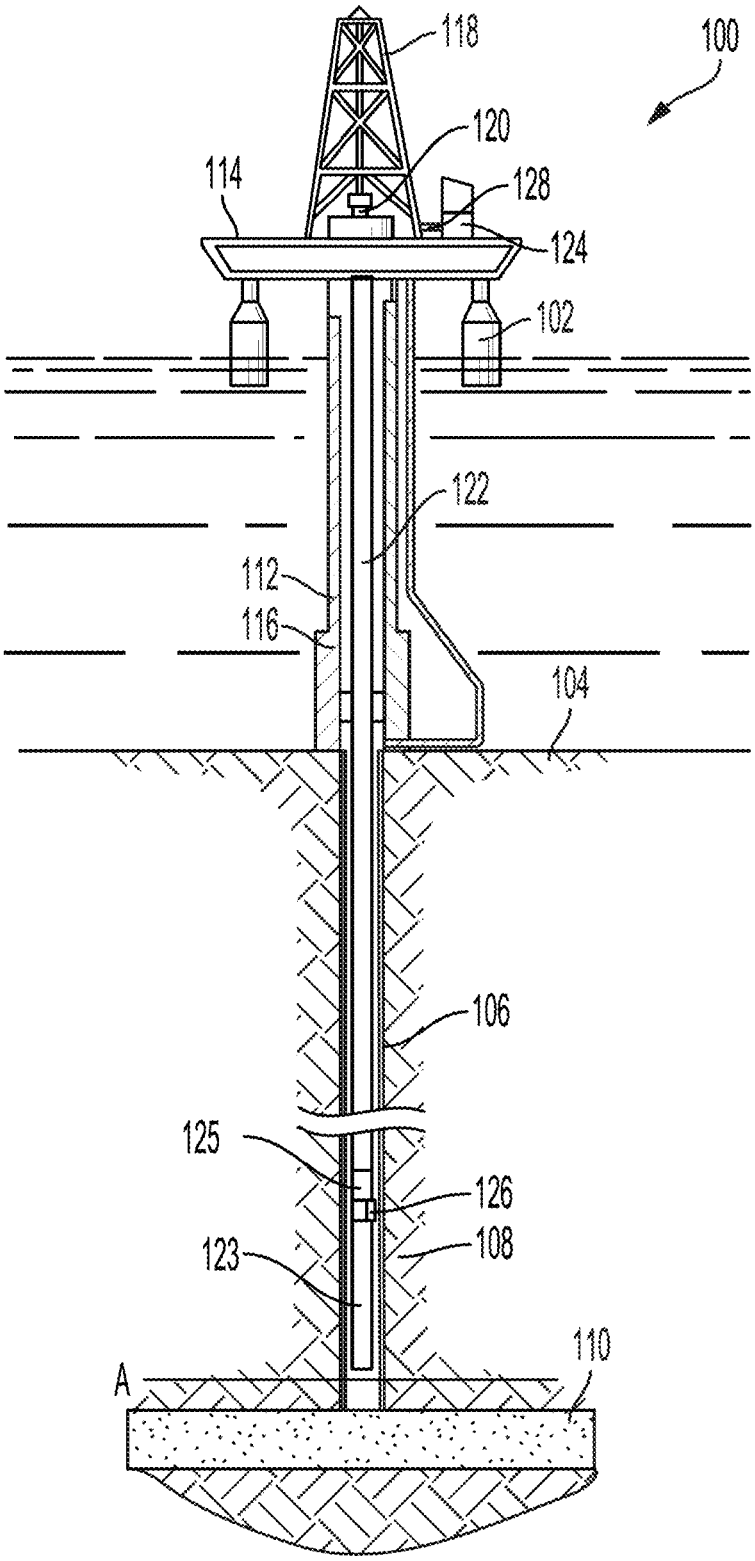
FIG. 1 is a sectional view of a well system that can include a wet mate connection system according to some examples of the present disclosure.

Certain aspects and examples of the present disclosure relate to a wet mate connection system that can supply power to one or more electrically operated wellbore tools positioned downhole in a wellbore. The one or more wellbore tools can include a safety valve, an insert valve, an inflow control valve, other suitable wellbore tools, or any combination thereof. The one or more wellbore tools can facilitate one or more wellbore operations such as a completion operation, a production operation, or the like. The wet mate connection system may include at least two wet mate connectors, and each of the wet mate connectors can include at least one conductor element. In one example, a first wet mate connector can be coupled with a tubing string positioned downhole in a wellbore, an electrical safety valve positioned downhole in the wellbore, or a combination thereof. The first wet mate connector can further be coupled with an electrical line (e.g., a tubing encapsulated conductor (TEC) line) to receive power from a power source. The first wet mate connector can further be coupled with a second wet mate connector. The second wet mate connector can be part of or be coupled with an insert valve or other suitable wellbore tool. When wet mate connectors are coupled (e.g., when the insert valve is inserted into the tubing string), an electrical contact can be provided between the conductor elements of the wet mate connectors. As a result, power from the electrical line can be supplied to the insert valve or other suitable wellbore tool that is part of or coupled with the second wet mate connector.

In current well systems, hydraulic insert valves can be used in conjunction with hydraulic safety valves to provide an additional layer of control and safety during wellbore operations. For example, the hydraulic safety valve can provide a fail-safe mechanism in case of overpressure downhole, while the hydraulic insert valve can control flow and pressure during normal operating conditions. However, there are various disadvantages associated with hydraulic valves. For example, hydraulic systems used to control the hydraulic insert and safety valves are often complex and can require regular maintenance. Additionally, the use of hydraulic systems can pose a risk of hazardous chemical or fluid leaks.

Electrical safety valves can overcome some of the disadvantages associated with the hydraulic valves. For example, electrical safety valves can have lower maintenance requirements, exhibit faster response times, and can be remotely operated. But, current electrical safety valves cannot receive electrical insert valves. For example, current electrical safety valves may not be mechanically compatible with electrical insert valves. Additionally, harsh conditions (e.g., high pressure, high temperatures, and corrosive fluids) in the wellbore and complex power requirements can make it difficult to use an electrical insert valve in conjunction with an electrical safety valve. Thus, there is a need for an improved system that enables the use of an electrical insert valve in conjunction with an electrical safety valve.

Some examples of the present disclosure can overcome one or more of the issues mentioned above by a wet mate connection system. The wet mate connection system can include a female wet mate connector and a male wet mate connector. The wet mate connectors can be pressure compensated using insulating materials (e.g., sealed chambers made of insulating plastics or other suitable insulating materials and filled with oil or other suitable incompressible fluids). The female wet mate connector can be terminated to a TEC line for receiving power. The TEC line can be deployed into the wellbore from the surface and can be coupled with a power source.

The female wet mate connector can be positioned downhole via a tubing string, while the male wet mate connector may be positioned downhole via an insert valve. Additionally, an electrically safety valve can be positioned downhole via the tubing string. The female wet mate connector can include a female latching profile and the male wet mate connector can include a male latching profile. Upon coupling the male wet mate connector and the female wet mate connector (e.g., by inserting the insert valve into the tubing string), the male latching profile and the female latching profile can latch. As a result, conducting elements of each of the wet mate connectors can be in contact with one another. Consequently, the power received by the female wet mate connector from the TEC line can be transmitted to the male wet mate connector.

Thus, by the connection of the female latching profile of the tubing string and the male latching profile of the electrical insert valve, the electrical insert valve can be positioned proximate to the electrical safety valve and can be provided electricity. This enables the electrical insert valve to be used in conjunction with the electrical safety valve to provide an additional layer of safety and operate in accordance with wellbore conditions. In particular, the electrical insert valve can provide the additional safety layer in case of failure of the electrical safety valve. Moreover, due to the ability to connect and disconnect the male and female latching profiles, the insert valve can be easily replaced after wear or in the case of a failure of the insert valve itself. In particular, the electrical insert valve can be removed from the tubing string and replaced without interfering with the positioning or operations of the electrical safety valve.

In a particular example, the electrical insert valve can include a piston, one or more springs, a flow tube, a ferromagnetic target, electromagnetic coils, and a flapper. When there is positive pressure from below the insert valve (e.g., when pressure exerted by the fluid or gas beneath the valve is greater than the pressure above the valve), the piston can move forward to compress a main spring. Additionally, during the positive pressure, a flow tube of the insert valve can stop at the flapper. Although the flow tube stops, the piston can continue to compress the main spring and a nose spring, which can be position between an opening prong and the flow tube. As a result of the compression of the main spring, a ferromagnetic target can be moved closer to the electromagnetic coils.

When power is switched on, a magnetic field can be generated around the electromagnetic coils, which can hold the ferromagnetic target in place. Pressure can then balance across the flapper, and, as a result, the compressed nose spring can cause the flapper to open, thereby putting the insert valve in an open state. During this, the ferromagnetic target can be held by a magnetic flux from the electromagnetic coil. Thus, the flow tube on which the ferromagnetic target is place can also remain in position. In contrast, to close the insert valve, power can be switched off which can release the ferromagnetic target and, as a result, the main power spring can push the flow tubes backward causing the valve to close.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a well system 100 that can include a wet mate connection system 126 according to some examples of the present disclosure. In the well system 100, a floating workstation 102 (e.g., an oil platform or an offshore platform) can be centered over a submerged oil or gas well located in a sea floor 104 having a wellbore 106. The wellbore 106 may extend from the sea floor 104 through a subterranean formation 108. The subterranean formation 108 can include a fluid-bearing formation 110. A subsea conduit 112 can extend from the deck 114 of the floating workstation 102 into a wellhead installation 116. The floating workstation 102 can have a derrick 118 and a hoisting apparatus 120 for raising and lowering tools to drill, test, and complete the oil or gas well. The floating workstation 102 can be an oil platform as depicted in FIG. 1 or an aquatic vessel capable of performing the same or similar drilling and testing operations. In some examples, the process described herein can be applied to a land-based environment for wellbore exploration, planning, drilling, and completion.

A tubing string 122 can be lowered into the wellbore 106 of the oil or gas well as part of a completion operation of the oil or gas well. Downhole fluids, such as production fluids, can flow through a flow path defined by the tubing string 122. The tubing string 122 can include one or more downhole tools usable downhole. The downhole tools can include wellbore stimulation equipment, production equipment, sand control tools, packers, retrievable tools, flow control devices, or any other suitable downhole tools.

In the example depicted in FIG. 1, the downhole tools can include an electrical insert valve 125 and an electrical safety valve 123. The tubing string 122 can additionally include the wet mate connection system 126 that can be used to provide electricity to the electrical insert valve 125, the electrical safety valve 123, or a combination thereof. For example, as shown and described in further detail below with respect to FIGS. 2-4, there can be an electrical line 128 deployed from a surface (e.g., the deck 114) through the tubing string 122 into the wellbore 106. The electrical line can be electrically coupled to a power source 124 (e.g., a DC power source, an AC power source, or the like) at the surface of the wellbore and with the wet mate connection system 126 downhole in the wellbore. The wet mate connection system 126 can then be electrically coupled to the electrical insert valve 125, the electrical safety valve 123, or a combination thereof. Thus, the wet mate connection system 126 can provide an electrical conduit for downhole tools such as safety and insert valves in fluid-bearing (e.g., subsea) formations. The electrical insert valve 125, electrical safety valve 123, and wet mate connection system 126 can be in an upper completion zone, above line A, for example. Then, the production zone 110 can be in a lower completion zone below line A.

Figure 2:
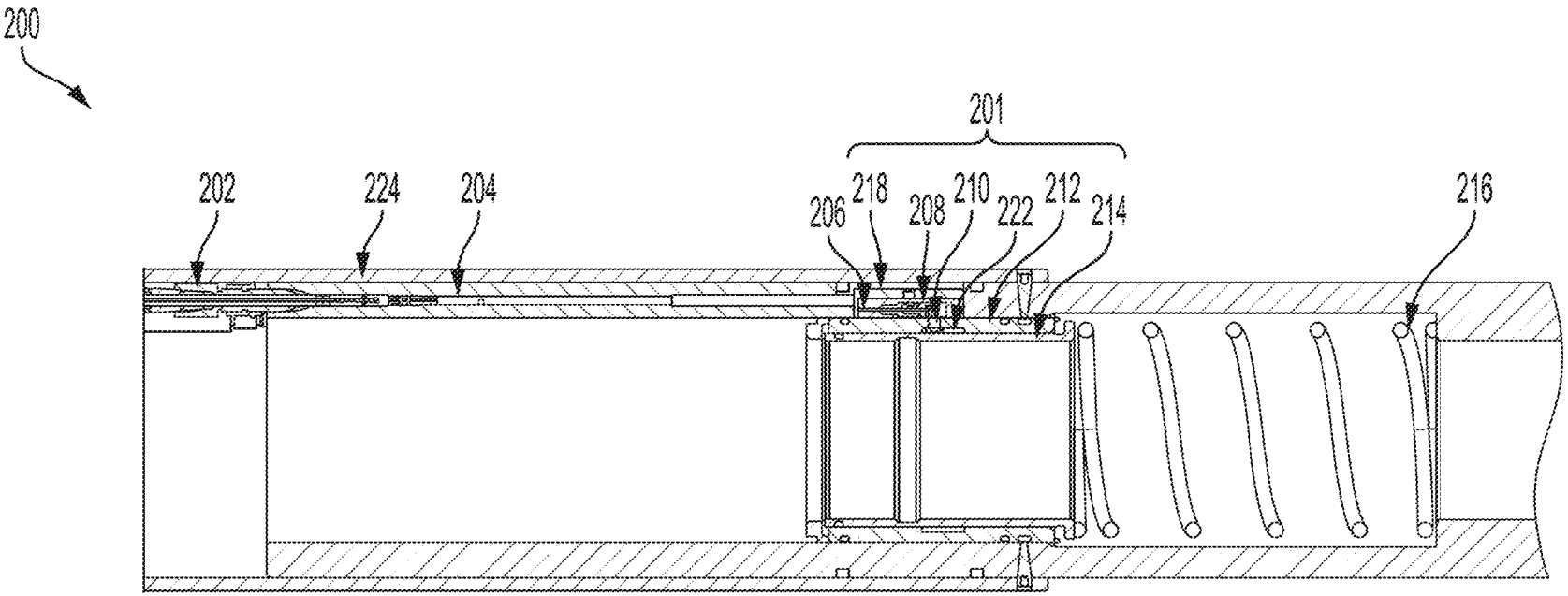
FIG. 2 is a sectional view of a wet mate connector for a wet mate connection system according to some examples of the present disclosure.

FIG. 2 is a sectional view of a wet mate connector 201 for a wet mate connection system 200 according to some examples of the present disclosure. The wet mate connection system 200 can correspond to the wet mate connection system 126 depicted in FIG. 1, and the tubing string 224 can correspond to the tubing string 122 depicted in FIG. 1. A wellbore (e.g., wellbore 106) in which the tubing string 224 can be deployed can formed in a subsea formation in a deepwater environment. In other examples, the wellbore can be formed in an onshore subterranean formation.

Regardless, the tubing string 224, an electrical line 204, other components of the wet mate connection system 200, or a combination thereof can be exposed to relatively high pressure differentials. The pressure differentials can be between an inside of the tubing string 224 and the deepwater, onshore, or other suitable environment associated with the wellbore. To balance the pressure differentials, and thereby prevent deformation or extrusion of the electrical line 204, tubing string 224, or the other suitable components, the wet mate connection system 200 can include one or more pressure compensating seals 202. The pressure compensating seals 202 can further prevent wellbore fluids from entering and damaging the electrical line 204. To do so, as illustrated in FIG. 2, the pressure compensating seals 202 can be positioned in an inner diameter of the tubing string 224 around the electrical line 204.

Additionally, the wet mate connection system 200 can include or be electrically coupled with the electrical line 204 (e.g., a tubing encapsulated conductor (TEC) line). The electrical line 204 can run adjacent to a wall of the tubing string 224, a casing string, or the like of the wellbore. The electrical line 204 can pass to an exterior of the tubing string 224 at an up-hole location (e.g., not shown). The electrical line 204 may include one or more electrical conductors (e.g., wire 206) and, as such, the electrical line 204 may be used as a conduit for electric power. For example, the electrical line 204 can run from a power source (e.g., power source 124), which may be positioned at a surface of the wellbore, to the wet mate connector 201, which may be positioned downhole in the wellbore. The power source can be a DC power source (e.g., battery, DC generator, fuel cell, or the like)) or the power source can be an AC power source (e.g., AC generator, transformer, or the like).

Figure 3:
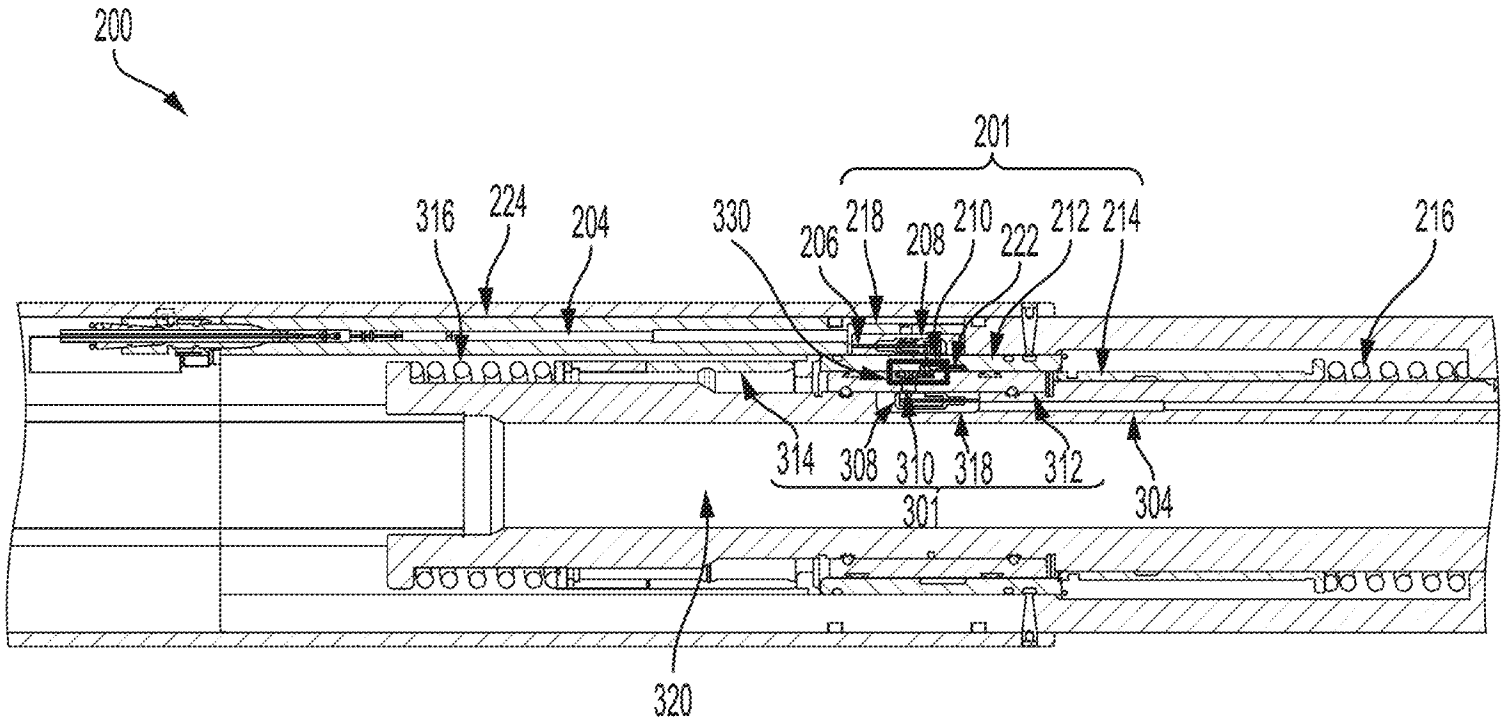
FIG. 3 is a sectional view of a wet mate connection system for supplying power to one more wellbore tools according to some examples of the present disclosure.

The wet mate connector 201 of the wet mate connection system 200 can include various components for receiving electricity and for coupling with another wet mate connector (e.g., wet mate connector 301 depicted in FIG. 3). For example, the wet mate connector 201 can include an insulating case 218, which can be made of a potting compound, a polymer, a ceramic, an encapsulating compound, or the like. The insulating case 218 can conceal conductive components of the wet mate connector 201, such as an electrical outlet 208, the wire 206, a conductive element 210, or a combination thereof. In doing so, the insulating case 218 can provide a protective layer for the conductive components. For example, the insulating case 218 can prevent damage to the conductive components by providing pressure balancing, electrical insulation, thermal resistance, and chemical resistance for the conductive components.

Additionally, the electrical outlet 208 of the wet mate connector 201 can be positioned downhole in the wellbore. The electrical outlet 208 may be electrically coupled with the electrical line 204. For example, the electrical line 204 can go into the insulating case 218 and, inside the insulating case 218, the wire 206 of the electrical line 204 can be electrically coupled with the electrical outlet 208. The electrical outlet 208 can further be electrically coupled with the conductive element 210 of the wet mate connector 201. Thus, the electricity from the electrical line 204 can be transmitted to the conductive element 210 via the electrical outlet 208, thereby rendering the first conductive element 210 electrically active.

The conductive element 210 can be a screw or other suitable component made of a conductive material (e.g., metal) and can transverse an insulating block 212 of the wet mate connector 201. In some examples, the conductive element 210 can comprise a projection 222 made of the same or a similar conductive material. In other examples, the projection 222 can be a separate conductive element (e.g., a metal plate) that is coupled with the conductive element 210. The projection 222 can be positioned on an inner side of the insulating block 212, which can be an opposite side of the insulating block 212 from which the insulating case 218 is positioned.

In some examples, the insulating block 212 and the insulating case 218 may be mechanically coupled. For example, the insulating block 212 and the insulating case 218 can be coupled via one or more latches, an adhesive, or another suitable mechanism. There may further be an opening in the insulating case 218 on a side that contacts the insulating block 212 to enable the electrical coupling of the conductive element 210 and the electrical outlet 208. A surface area between the insulating block 212 and the insulating case 218 and around the opening can be sealed to prevent fluids from entering and coming in contact with the conductive components (e.g., the electrical outlet 208 and conductive element 210).

The wet mate connection system 200 can further include a spring 216. The spring is a biasing element used to hold the cover over the electrode and to protect it from electrical shorting. Alternative biasing elements can be used including a collet and frangible devices like shear pins. As shown in FIG. 2, prior to inserting an insert valve into the tubing string 224, there may not be external force on the spring 216. In contrast, as shown and described below with respect to FIG. 3, upon inserting an insert valve with into the tubing string 224, the spring 216 can be compressed. The other biasing elements would be released. For example, the wet mate connector 201 can include an insulating cover 214 which can slide relative to the insulating block 212 toward the spring 216. As shown in FIG. 2, prior to inserting the insert valve, the insulating cover 214 can conceal the conductive element 210 and the projection 222. But, as shown and described below with respect to FIG. 3, upon inserting the insert valve, the insulating cover 214 can be pushed toward the spring 216. Consequently, the insulating cover 214 can compress the spring 216 and the projection 222 and conductive element 210 can be uncovered.

Referring now to FIG. 3, FIG. 3 is a sectional view of the wet mate connection system 200 for supplying power to one more wellbore tools according to some examples of the present disclosure. In some examples, the wet mate connector 201 can be a first wet mate connector (e.g., a female wet mate connector). Thus, the electrical outlet 208, the insulating case 218, the conductive element 210, the projection 222, the insulating block 212, and the insulating cover 214 can be a first electrical outlet 208, a first insulating case 218, a first conductive element 210, a first projection 222, a first insulating block 212, and a first insulating cover 214.

The wet mate connection system 200 may further include a second wet mate connector 301 (e.g., a male wet mate connector). The components of the second wet mate connector 301 can be similar and complementary to the first wet mate connector 201. For example, the second wet mate connector 301 can include a second electrical outlet 308, a second insulating case 318, a second conductive element 310, a second projection, a second insulating block 312, and a second insulating cover 314.

Additionally, the wet mate connection system 200 can include or be coupled with a valve 320. For example, the valve 320 can be an electrical insert valve and can be positioned within (e.g., insert into) the tubing string 224. The valve 320 can be proximate to a permanent valve (not shown) (e.g., a tubing conveyed safety valve) in the wellbore, which may be mounted on the tubing string 224. For example, the valve 320 can be axially displaced but within about 100 meters of the permanent valve. Both the valve 320 and the permanent valve can be positioned above a production zone through which fluid can be flowing. That is, both the valve 320 and the permanent valve can be in an upper completion zone while a production zone can be in a lower completion zone. In some examples, the valve 320 and the permanent valve can be electrical valves driven by electric motors and electric breaks. Additionally, in some examples, the valve 320 can be configured to obstruct axial flow along the wellbore.

The second wet mate connector 301 can be disposed on an outer side of the valve 320, while the first wet mate connector 201 can be disposed on an inner side of the tubing string 224. Consequently, the first wet mate connector 201 and the second wet mate connector 301 can be coupled when the valve 320 is positioned within the tubing string 224. Coupling the first wet mate connector 201 and the second wet mate connector 301 can facilitate a supply of power to the valve 320.

For example, the first electrical outlet 208, which can be positioned within and protected by a first insulating case 218, can be electrically coupled with a first electrical line 204. The first electrical line 204 can also be electrically coupled with a power source 124 associated with a wellbore 106 in which the wet mate connection system 200 is deployed. The first conductive element 210 of the first wet mate connector 201 can also be electrically coupled with the electrical outlet 208. Thus, power can be supplied to the first conductive element 210 via the first electrical outlet 208.

The second wet mate connector 301 can also include a second conductive element 310. The first conductive element 210 can traverse a first insulating block 212, while the second conductive element 310 can traverse a second insulating block 312. Additionally, the first wet mate connector 201 can include a first insulating cover 214 and the second wet mate connector 301 can include a second insulating cover 314. Prior to coupling the first wet mate connector 201 and the second wet mate connector 301, the first insulating cover 214 can conceal the first conductive element 210 (e.g., the first insulating cover 214 can be in a position in which it covers the first conductive element 210). Such positioning of the first insulating cover 214 is depicted in FIG. 2. Similarly, prior to coupling the first wet mate connector 201 and the second wet mate connector 301, the second insulating cover 314 can conceal the second conductive element 310 (e.g., the second insulating cover 314 can be in a position in which it covers the second conductive element 310).

Conversely, upon coupling of the first wet mate connector 201 and the second wet mate connector 301, the first insulating cover 214 and the second insulating cover 314 can be moved with respect to the first insulating block 212 and the second insulating block 310 respectively. For example, as the first wet mate connector 201 and the second wet mate connector 301 are coupled, the first insulating block 212 can push the second insulating cover 314 towards a second spring 316. Substantially contemporaneous to the first insulating block 212 pushing the second insulating cover 314, the second insulating block 312 can push the first insulating cover 214 toward a first spring 216. Thus, when the first wet mate connector 201 and the second wet mate connector 301 are coupled, the first spring 216 and the second spring 316 can be compressed.

While the first insulating cover 214 is pushed toward the first spring 216 and the second insulating cover 314 is pushed toward the second spring 314, the first insulating block 212 and the second insulating block 312 can come into contact with one another. As a result, as shown in FIG. 3, the first insulating block 212 and the second insulating block 312 can be coupled in an overlapping fashion. The overlapping of the first insulating block 212 and the second insulating block 312 can cause an electrical contact 330 to be made between the first conductive element 210 and the second conductive element 310. The second conductive element 310 can be part of a three-phase power, a telemetry channel, an electrical return path, a second power channel for redundancy, a second power channel for high-power operations, a channel to provide a health check on the downhole tool, or the like. Although one electrical contact is shown, the first and second wet mate connectors can include any number of conductive elements for making any number of electrical contacts. Additional electrical contacts may be electrically coupled with the outlets 208, 308 or the wet mate connectors may include a different number of electrical outlets.

Due to the first conductive element 210 receiving power from the power source, when the electrical contact 330 is made the second conductive element 310 can also receive the power. The second conductive element 310 may also be electrically coupled with the second electrical outlet 308. Additionally, a second electrical line 304 (e.g., another TEC line) can be electrically coupled with the second electrical outlet 308 and with the valve 320. Power can be supplied from the second conductive element 310 to the valve 320 via the second electrical line 304.

Thus, the wet mate connection system 200 can enable the use of electrical valves in wellbore operations. More specifically, due to the wet mate connection system 200 including insulating components (e.g., the insulating covers, insulating blocks, and insulating cases) for providing pressure compensation and protection from wellbore fluids, power can be supplied despite harsh conditions within a wellbore. For example, the wet mate connection system 200 can be used to supply power to electrical valves in deep sea or offshore wellbore environments.

Additionally, upon removal of the valve 320 from the tubing string 224, the first spring 216 and the second spring 316 can decompress as the second insulating cover 314 and the first insulating cover 214 slide back over the second insulating block 312 and the first insulating block 212. Thus, the first conductive element 210 and the second conductive element 310 can be protected during removal of the valve 320. In this way, the wet mate connection system 200 can facilitate efficient electrical and mechanical coupling and decoupling of the valve 320. Thus, the valve 320 can be easily positioned and easily replaced.

Figure 4:
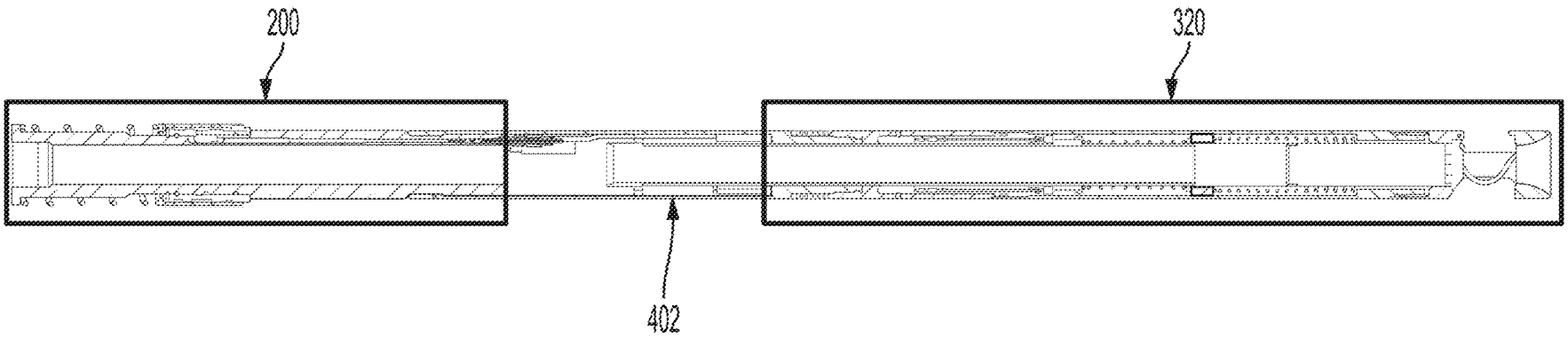
FIG. 4 is a schematic of a wet mate connection system for supplying power to one more wellbore tools according to some examples of the present disclosure.

FIG. 4 is a schematic of a wet mate connection system 200 for supplying power to one more wellbore tools according to some examples of the present disclosure. In some examples, the wellbore tool can be a valve 320 that can be controlled by an electromagnetic coil system 402. In such examples, the wet mate connection system 200 can supply power to the electromagnetic coil system 402 to cause the valve (e.g., an electrical safety valve or an electrical insert valve) to open or close.

For example, the second electrical line 304 may be coupled with the electromagnetic coil system 402. Therefore, as a result of coupling the first wet mate connector 201 and the second wet mate connector 301, power can be supplied to the electromagnetic coil system 402. When power is being transmitted to the electromagnetic coil system 402, a magnetic field can be generated around electromagnetic coils of the electromagnetic coil system 402. The magnetic field can hold a ferromagnetic target associated with a flow tube of the valve 320 in place, which can cause the valve 320 to be in an open state. In contrast, to close the valve 320, power can be switched off which can release the ferromagnetic target and, as a result, cause the valve 320 to close.

In other examples, the valve 320 can have an electric motor and an electric brake. In such examples, while the wet mate connection system 200 is supplying power to the valve 320, the electric motor can turn a ball screw assembly, can compress a power spring 216, and can open the valve 320. The electric break can hold the valve 320 in an open position. In contrast, if power is turned off, then the spring 216 can cause the valve 320 to close.

Figure 5:
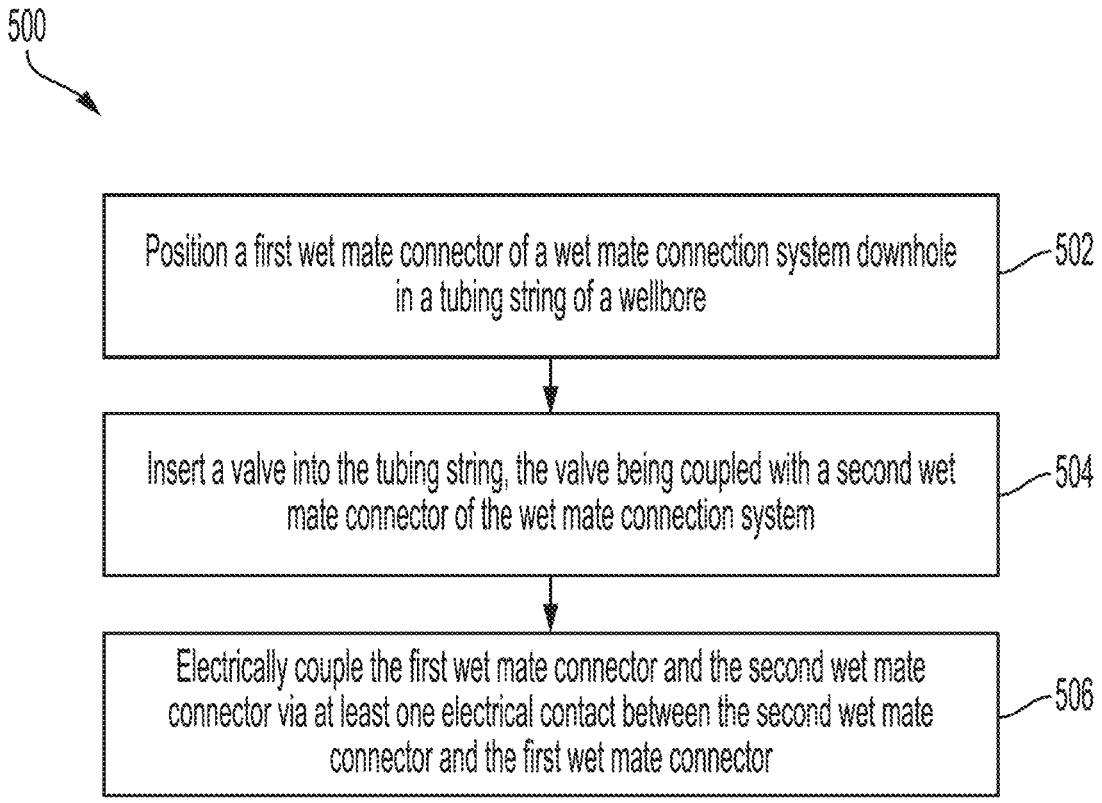
FIG. 5 is a flowchart of a process for supplying power to one or more wellbore tools using a wet mate connection system according to some examples of the present disclosure.

FIG. 5 is a flowchart of a process 500 for supplying power to one or more wellbore tools using a wet mate connection system according to some examples of the present disclosure. In other examples, the process 500 can include more steps, fewer steps, different steps, or a different order of the steps depicted in FIG. 5. The steps of FIG. 5 are described below with reference to components discussed above in FIGS. 1-4.

At block 502, the process 500 can involve positioning a first wet mate connector 201 of a wet mate connection system 200 downhole in a tubing string 224 of a wellbore 106. For example, the first wet mate connector 201 may be positioned along an inner wall of the tubing string 224.

Additionally, in some examples, the first wet mate connector 201 can be positioned proximate to a valve (e.g., a tubing conveyed safety valve) mounted on the tubing string 224. For example, the first wet mate connector 201 can be between 1 and 200 meters of the valve. The valve may be locked or otherwise prevented from closing by a sleeve or other suitable element.

The first wet mate connector 201 can further be electrically active. For example, the first wet mate connector 201 can include a first electrical outlet 208, which can be positioned within and protected by a first insulating case 218. A first end of a first electrical line 204 (e.g., a tubing encapsulated conductor (TEC) line) can be electrically coupled with a power source 124 associated with the wellbore 106, while a second end of the first electrical line 204 can be coupled with electrically coupled with the first electrical outlet 208. Thus, power can be supplied to the first wet mate connector 201 from the power source 124 via the electrical coupling of the electrical line 204 and the first electrical outlet 208.

At block 504, the process 500 can involve inserting a valve 320 into the tubing string 224. The valve 320 can be a different valve from the valve mounted on the tubing string. For example, the valve 320 can be an electrical insert valve while the valve mounted on the tubing string can be a tubing conveyed safety valve. The valve 320 can be coupled with a second wet mate connector 301 of the wet mate connection system 200. The valve 320 can be any suitable electrical valve that can be used in any suitable wellbore operation (e.g., completion operation, production operation, etc.). Examples of such electrical valves can include electrical safety valves, electrical gate valves, electrical ball valves, electrical insert valves, or the like.

As will be discussed in further detail below with respect to block 506, the second wet mate connector 301 can be coupled with the valve 320 such that positioning the valve 320 in the tubing string 224 facilitates at least one electrical contact 330 between the first wet mate connector 201 and the second wet mate connector 301. The second wet mate connector 301 can include at least some of the same components as the first wet mate connector 201. For example, the second wet mate connector 301 can include a second electrical outlet 308, which can be positioned within and protected by a second insulating case 318.

At block 506, the process 500 can involve electrically coupling the first wet mate connector 201 and the second wet mate connector 301 via at least one electrical contact 330 between the second wet mate connector 301 and the first wet mate connector 201. For example, as described above the first wet mate connector 201 can be supplied power from a power source. The first wet mate connector 201 can further include a first conductive element 210, which can be electrically coupled to the electrical outlet 208. Thus, the first conductive element 210 can be electrically active. Similarly, the second wet mate connector 301 can include a second conductive element 310. The first conductive element 210 can traverse a first insulating block 212 and the second conductive element 310 can traverse a second insulating block 312.

Additionally, the first wet mate connector 201 can include a first insulating cover 214 and the second wet mate connector 301 can include a second insulating cover 314. Prior to inserting the valve 320, and thereby coupling the first wet mate connector 201 and the second wet mate connector 301, the first insulating cover 214 can be positioned to conceal the first conductive element 210 and the second insulating cover 314 can be positioned to conceal the second conductive element 310.

Conversely, upon inserting the valve 320 into the tubing string 224, the coupling of the first wet mate connector 201 and the second wet mate connector 301 can remove the first insulating cover 214 to expose the first conductive element 210 and can remove the second insulating cover 314 to expose second conductive element 310. In particular, as the first wet mate connector 201 and the second wet mate connector 301 are coupled, the first insulating block 212 can push the second insulating cover 314 off of the second insulating block 312 and towards a second spring 316. Substantially contemporaneous to the first insulating block 212 pushing the second insulating cover 314, the second insulating block 312 can push the first insulating cover 214 off of the first insulating block 212 and toward a first spring 316. Consequently, when the first wet mate connector 201 and the second wet mate connector 301 are coupled, the first spring 216 and the second spring 316 can be compressed.

The electrical contact 330 can be made as a result of exposing conductive elements and coupling the wet mate connectors. The electrical contact 330 can be between the first conductive element 210 and the second conductive element 310. Due to the first conductive element 210 being electrically active, the second conductive element 310 can be electrically active while in contact with the first conductive element 210. Additionally, the second conductive element 310 can be electrically coupled with the second electrical outlet 308. Then, a first end of a second electrical line 304 (e.g., another TEC line) can be electrically coupled with the second electrical outlet 308, while a second end of the second electrical line 304 can be electrically coupled with the valve 320. Thus, power can be supplied to the valve 320 from the power source 124 via the electrical coupling of the first wet mate connector 201 and the second wet mate connector 301. If power is not supplied to the valve 320 (e.g., if the power source 124 is turned off), the valve 320 can close automatically while the conductive elements are in contact. The spring 216 or a similar mechanism (e.g., pressurized gas) may cause the automatic closure of the valve 320

In some aspects, systems and methods for a downhole wet mate connection system for a wellbore tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a valve positionable downhole in a wellbore; and a wet mate connection system positionable downhole in the wellbore and electrically couplable with the valve, the wet mate connection system comprising: a first wet mate connector; a second wet mate connector couplable with the first wet mate connector and with the valve; and at least one electrical contact between the first wet mate connector and the second wet mate connector.

Example 2 is the system of example(s) 1, wherein the first wet mate connector is configured to receive electricity from a power source via an electrical line, and wherein the electricity is transmitted from the first wet mate connector to the valve via the at least one electrical contact between the first wet mate connector and the second wet mate connector.

Example 3 is the system of example(s) 1-2, wherein the first wet mate connector comprises an electrical outlet, and wherein the first wet mate connector is configured to receive the electricity from the power source via electric coupling of the electrical outlet and the electrical line.

Example 4 is the system of example(s) 1-3, wherein the at least one electrical contact is between at least a first conductive element of the first wet mate connector and a second conductive element of the second wet mate connector.

Example 5 is the system of example(s) 1-4, wherein the first conductive element traverses a first insulating block of the first wet mate connector, and wherein the second conductive element traverses a second insulating block of the second wet mate connector.

Example 6 is the system of example(s) 1-5, wherein the first wet mate connector comprises a first insulating cover that is configured to slide with respect to the first insulating block, and wherein the second wet mate connector comprises a second insulating cover that is configured to slide with respect to the second insulating block.

Example 7 is system of example(s) 1-6, wherein the first wet mate connector comprises a first electrical outlet and a first insulating case, wherein the second wet mate connector comprises a second electrical outlet and second insulating case, wherein the first electrical outlet is positioned within the first insulating case, and wherein the second electrical outlet is positioned within the second insulating case.

Example 8 is the system of example(s) 1-7, wherein the wellbore is a subsea wellbore and the valve in an insert valve, wherein the insert valve is positioned proximate to an additional valve positioned downhole in the wellbore, and wherein the additional valve is a tubing conveyed safety valve.

Example 9 is wet mate connection system comprising: a first wet mate connector positionable downhole in a wellbore; a second wet mate connector couplable with the first wet mate connector and with a valve positionable downhole in the wellbore; and at least one electrical contact between the first wet mate connector and the second wet mate connector.

Example 10 is the wet mate connection system of example(s) 9, further comprising a power source and an electrical line, wherein the first wet mate connector is configured to receive electricity from the power source via the electrical line, and wherein the electricity is transmitted from the first wet mate connector to the valve via the at least one electrical contact between the first wet mate connector and the second wet mate connector.

Example 11 is the wet mate connection system of example(s) 9-10, wherein the first wet mate connector comprises an electrical outlet, and wherein the first wet mate connector is configured to receive the electricity from the power source via electric coupling of the electrical outlet and the electrical line.

Example 12 is the wet mate connection system of example(s) 9-11, wherein the at least one electrical contact is between at least a first conductive element of the first wet mate connector and a second conductive element of the second wet mate connector.

Example 13 is the wet mate connection system of example(s) 9-12, wherein the first conductive element traverses a first insulating block of the first wet mate connector, and wherein the second conductive element traverses a second insulating block of the second wet mate connector.

Example 14 is the wet mate connection system of example(s) 9-13, wherein the first wet mate connector comprises a first insulating cover that is configured to slide with respect to the first insulating block, and wherein the second wet mate connector comprises a second insulating cover that is configured to slide with respect to the second insulating block.

Example 15 is the wet mate connection system of example(s) 9-14, wherein the first wet mate connector comprises a first electrical outlet and a first insulating case, wherein the second wet mate connector comprises a second electrical outlet and second insulating case, wherein the first electrical outlet is positioned within the first insulating case, and wherein the second electrical outlet is positioned within the second insulating case.

Example 16 is a method comprising: positioning a first wet mate connector of a wet mate connection system downhole in a tubing string of a wellbore; inserting a valve into the tubing string, the valve being coupled with a second wet mate connector of the wet mate connection system; and electrically coupling the first wet mate connector and the second wet mate connector via at least one electrical contact between the second wet mate connector and the first wet mate connector.

Example 17 is the method of example(s) 16, further comprising: electrically coupling the first wet mate connector to a power source using an electrical line; and supplying power from the first wet mate connector to the valve via the at least one electrical contact between the first wet mate connector and the second wet mate connector.

Example 18 is the method of example(s) 16-17, wherein the first wet mate connector comprises an electrical outlet, and wherein electrically coupling the first wet mate connector to the power source using the electrical line comprises; electrically coupling a first end of the electrical line to the power source; and electrically coupling a second end of the electrical line to the electrical outlet.

Example 19 is the method of example(s) 16-18, wherein the at least one electrical contact is between at least a first conductive element of the first wet mate connector and a second conductive element of the second wet mate connector.

Example 20 is the method of example(s) 16-19, wherein the first conductive element traverses a first insulating block of the first wet mate connector, and wherein the second conductive element traverses a second insulating block of the second wet mate connector.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a valve positionable downhole in a wellbore; and a wet mate connection system positionable downhole in the wellbore and electrically couplable with the valve, the wet mate connection system comprising:

a first wet mate connector comprising a conductive element, an electrical outlet, an insulating block, and an insulating case, wherein the conductive element traverses the insulating block to contact the electrical outlet that is positioned internal to the insulating case, and wherein a surface area between the insulating case and the insulating block is sealed to fluidly isolate the contact between the electrical outlet and the conductive element;

a second wet mate connector couplable with the first wet mate connector and with the valve; and at least one electrical contact between the conductive element of the first wet mate connector and the second wet mate connector.

2. The system of claim 1, wherein the first wet mate connector is configured to receive electricity from a power source via an electrical line, and wherein the electricity is transmitted from the first wet mate connector to the valve via the at least one electrical contact between the conductive element of the first wet mate connector and the second wet mate connector.

3. The system of claim 2, wherein the first wet mate connector is configured to receive the electricity from the power source via electric coupling of the electrical outlet and the electrical line.

4. The system of claim 1, wherein the conductive element is a first conductive element, and wherein the at least one electrical contact is between at least the first conductive element of the first wet mate connector and a second conductive element of the second wet mate connector.

5. The system of claim 4, wherein the electrical outlet is a first electrical outlet, the insulating block is a first insulating block, and the insulating case is a first insulating case, wherein the second wet mate connector comprises the second conductive element, a second electrical outlet, a second insulating block, and a second insulating case, and wherein the second conductive element traverses the second insulating block to contact the second electrical outlet that is positioned internal to the second insulating case.

6. The system of claim 5, wherein the first wet mate connector further comprises a first insulating cover that is configured to slide with respect to the first insulating block, and wherein the second wet mate connector further comprises a second insulating cover that is configured to slide with respect to the second insulating block.

7. The system of claim 1, wherein the wellbore is a subsea wellbore and the valve in an insert valve, wherein the insert valve is positioned proximate to an additional valve positioned downhole in the wellbore, and wherein the additional valve is a tubing conveyed safety valve.

8. A wet mate connection system comprising:

a first wet mate connector positionable downhole in a wellbore, the first wet mate connector comprising a conductive element, an electrical outlet, an insulating block, and an insulating case, wherein the conductive element traverses the insulating block to contact the electrical outlet that is positioned internal to the insulating case, and wherein a surface area between the insulating case and the insulating block is sealed to fluidly isolate the contact between the electrical outlet and the conductive element;

a second wet mate connector couplable with the first wet mate connector and with a valve positionable downhole in the wellbore; and at least one electrical contact between the conductive element of the first wet mate connector and the second wet mate connector.

9. The wet mate connection system of claim 8, further comprising a power source and an electrical line, wherein the first wet mate connector is configured to receive electricity from the power source via the electrical line, and wherein the electricity is transmitted from the first wet mate connector to the valve via the at least one electrical contact between the conductive element of the first wet mate connector and the second wet mate connector.

10. The wet mate connection system of claim 9, wherein the first wet mate connector is configured to receive the electricity from the power source via electric coupling of the electrical outlet and the electrical line.

11. The wet mate connection system of claim 8, wherein the conductive element is a first conductive element, and wherein the at least one electrical contact is between at least the first conductive element of the first wet mate connector and a second conductive element of the second wet mate connector.

12. The wet mate connection system of claim 11, wherein the electrical outlet is a first electrical outlet, the insulating block is a first insulating block, and the insulating case is a first insulating case, wherein the second wet mate connector comprises the second conductive element, a second electrical outlet, a second insulating block, and a second insulating case, and wherein the second conductive element traverses the second insulating block to contact the second electrical outlet that is positioned internal to the second insulating case.

13. The wet mate connection system of claim 12, wherein the first wet mate connector further comprises a first insulating cover that is configured to slide with respect to the first insulating block, and wherein the second wet mate connector further comprises a second insulating cover that is configured to slide with respect to the second insulating block.

14. A method comprising:

positioning a first wet mate connector of a wet mate connection system downhole in a tubing string of a wellbore, the first wet mate connector comprising a conductive element, an electrical outlet, an insulating block, and an insulating case, wherein the conductive element traverses the insulating block to contact the electrical outlet that is positioned internal to the insulating case, and wherein a surface area between the insulating case and the insulating block is sealed to fluidly isolate the contact between the electrical outlet and the conductive element;

inserting a valve into the tubing string, the valve being coupled with a second wet mate connector of the wet mate connection system; and electrically coupling the first wet mate connector and the second wet mate connector via at least one electrical contact between the second wet mate connector and the conductive element of the first wet mate connector.

15. The method of claim 14, further comprising:

electrically coupling the first wet mate connector to a power source using an electrical line; and supplying power from the first wet mate connector to the valve via the at least one electrical contact between the conductive element of the first wet mate connector and the second wet mate connector.

16. The method of claim 15, wherein electrically coupling the first wet mate connector to the power source using the electrical line comprises;

electrically coupling a first end of the electrical line to the power source; and electrically coupling a second end of the electrical line to the electrical outlet.

17. The method of claim 14, wherein the conductive element is a first conductive element, and wherein the at least one electrical contact is between at least the first conductive element of the first wet mate connector and a second conductive element of the second wet mate connector.

18. The method of claim 17, wherein the electrical outlet is a first electrical outlet, the insulating block is a first insulating block, and the insulating case is a first insulating case, wherein the second wet mate connector comprises the second conductive element, a second electrical outlet, a second insulating block, and a second insulating case, and wherein the second conductive element traverses the second insulating block to contact the second electrical outlet that is positioned internal to the second insulating case.

* * * * *